United States Patent [19]

Wolfenden

[11] Patent Number: 4,643,482

[45] Date of Patent: Feb. 17, 1987

[54] STEERING OF MINING MACHINES

[75] Inventor: John R. Wolfenden, Draycott-in-the-Clay, England

[73] Assignee: Coal Industry (Patents) Limited, England

[21] Appl. No.: 623,106

[22] Filed: Jun. 21, 1984

[30] Foreign Application Priority Data

Aug. 2, 1983 [GB] United Kingdom ..... 8320840

[51] Int. Cl.[4] ..... E21C 27/24; E21C 35/08

[52] U.S. Cl. ..... 299/1; 299/42

[58] Field of Search ..... 299/1, 42

[56] References Cited

U.S. PATENT DOCUMENTS 4,008,921 2/1977 Czauderna et al. ..... 299/1

4,155,594 5/1979 Hartley et al. ..... 299/1

FOREIGN PATENT DOCUMENTS 3205067 8/1983 Fed. Rep. of Germany ..... 299/1

1383756 2/1975 United Kingdom ..... 299/1

1443227 7/1976 United Kingdom .

2027548 2/1980 United Kingdom ..... 299/1

*Primary Examiner*—Stephen J. Novosad

*Assistant Examiner*—Thomas J. Odar

*Attorney, Agent, or Firm*—Stevens, Davis, Miller & Mosher

[57] ABSTRACT

A double-ended ranging drum shearer is steered along a longwall face by using a series of spaced reference locations A, B, C, D, E, F, G, H. I . . . . The machine position is sensed so as to identify when the leading and trailing drum reach each desired reference location. The cutting horizon of each drum is sensed at each reference location and steering corrections applied if necessary.

10 Claims, 1 Drawing Figure

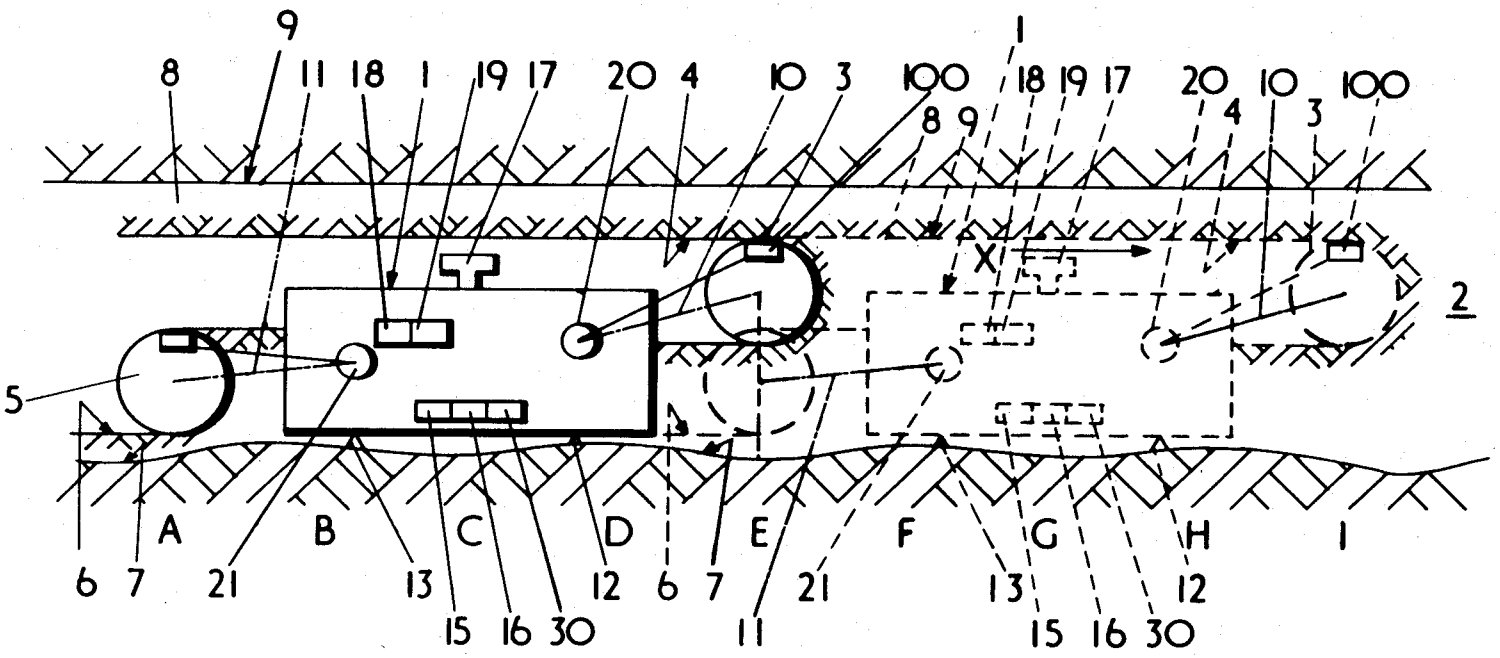
2
1
100
3
10
4
20
17
19
18
1
X
100
9
8
3
10
4
20
17
19
1
18
11
9
8
5
A
B
C
D
E
F
G
H
7
6
21
11
7
6
12
30
16
15
13
21
12
30
16
15
13

STEERING OF MINING MACHINES

The present invention relates to steering of mining machines along working faces in underground mineral seams.

In particular the invention relates to steering mineral cutter means provided on a double ended ranging drum shearer which during a traverse along a working face has a leading end cutting drum arranged to win a relatively upper strip portion of mineral to form a mine roof and a trailing end cutting drum arranged to win a relatively lower strip portion to mineral to form a mine floor.

Our prior British patent specification Ser. No. 1 443 227 described and claimed a method of an apparatus for steering mineral cutter means which win a strip of mineral by separate roof and floor cutting stages, wherein the cutting horizon or rock boundary associated with one of the cutting stages is sensed to control the cutting horizon associated with the other cutting stage.

It is an object of the present invention to provide an improved method of apparatus for steering mineral cutter means.

According to one aspect of the present invention a method of steering mineral cutter means provided on a double ended ranging drum shearer adapted to repeatedly traverse to and fro along a longwall working face comprises the steps of using a number of reference locations spaced at preselected intervals along the longwall working face, sensing the position of the machine along the working face so as to identify when the leading cutter drum reaches a desired reference location, sensing the cutting horizon of the leading cutter drum at said desired reference location, further sensing the position of the machine along the working face so as to identify when the trailing cutter drum reaches said desired reference location, and steering the trailing cutter drum such that the vertical thickness of the strip of mineral won at said desired reference location tends to be maintained at a preselected value.

Advantageously, sensing the cutting horizon of the cutter drums comprises sensing the thickness of a residual layer of mineral left behind the leading cutter drum, and sensing the horizon of the cutter drums relatively to the mining machine and sensing the tilt of the mining machine.

Advantageously, the tilt of the machine is sensed both in the direction of machine traverse along the working face and in a direction transverse to the direction of machine traverse.

Preferably, a series of reference locations are used, the series extending along at least a portion of the working face.

According to another aspect of the present invention apparatus for steering mineral cutter means provided on a double ended ranging drum shearer adapted to repeatedly traverse to and fro along a longwall working face comprises odometer means for sensing the position of the machine along the working face and for identifying when the leading cutter drum reaches a desired reference location along the working face and for identifying when the trailing cutter drum reaches said desired reference locations, sensor means for sensing the cutting horizon of the leading cutter drum at said desired reference location and for deriving first and second signal means indicative of the two sensed cutting horizons, respectively, processor means for receiving derived signal means, and for storing at least said first signal means, and steering control means for steering the trailing cutter drum such that the vertical thickness of the strip of mineral won at said desired reference location tends to be maintained at a preselected value.

Advantageously, the odometer means derives first and second signal means indicative of when the leading and trailing cutter drums reach said desired reference location, respectively, the derived signals being transmitted to the processor means.

Preferably, the sensor means comprises a first sensor for sensing the thickness of a residual layer of mineral left behind the leading cutter drum, a sensor for sensing the horizon of the cutter drums relatively to the mining machine and further sensors for sensing the tilt of the mining machine.

Advantageously, said further sensors comprises a tilt transducer for sensing the tilt of the mining machine in the direction of machine traverse and a tilt transducer for sensing the tilt of the mining machine in a direction transverse to the direction of machine traverse.

Preferably, the odometer means is adapted to identify when the cutter drums reach each of a series of spaced reference locations, the series extending along at least a portion of the longwall working face.

Preferably, override means are provided for limiting the maximum extent of any steering correction applied to the cutter drums.

By way of example, one embodiment of the present invention will be described with reference to the accompanying drawing which shows diagrammatically a double ended ranging drum shearer at two different locations along a longwall working face.

The drawing shows diagrammatically a mining machine of a type known as a double ended ranging drum shearer 1 traversing along a longwall working face 2 in a direction indicated by arrow x. In the drawing the machine is shown in full line at one location along the working face and is shown in broken line at a second location along the working face. The significance of showing the two locations will be made clear later in this specification.

The double ended ranging drum shearer comprises a currently leading cutter drum 3 arranged to win mineral at a relatively upper strip portion of the mineral seam to form the mine roof 4 and a currently trailing cutter drum 5 arranged to win mineral at a relatively lower strip portion of the mineral seam to form the mine floor 6. The mine floor formed on the previous machine cutting traverse along the face is indicated by reference number 7.

As seen in the drawing a residual layer of mineral 8 is left behind the leading cutter drum 3 between the mine roof 4 and the upper mineral/rock boundary 9.

The two rotary cutter drums 3 and 5 are supportedly mounted on booms 10 and 11 projecting from opposite ends of the machine body, each of the two booms is capable of being pivoted about a horizontal axis under the action of a ram (not shown). Pivotal movement of the booms ranging the cutter drums to apply desired steering adjustments. The rotary cutter drums are driven from a motor (not shown) mounted on the body of the machine via gearing extending along the booms. The machine also comprises two pairs of feet 12, 13 arranged to move along a path extending along the working face adjacent to a longwall armoured face conveyor. The feet may move along a path provided by the conveyor or along a path constituted by the mine floor.

The machine is repeatedly hauled to and fro along the working face by haulage means (not shown).

It will be appreciated that as the machine repeatedly traverses to and fro along the working face it is always the currently leading cutter drum 3 or 5 which wins the relatively upper strip-portion of the mineral and the currently trailing cutter drum 5 or 3 which wins the relatively lower strip-portion of the mineral. Thus, upon reaching the end of a cutting traverse along the working face the aforementioned rams are activated to pivot the booms and range the two cutter drums to adjust the cutting horizon of the drums ready for the machine commencing a new cutting traverse in the opposite direction.

The mining machine is provided with apparatus for steering the cutter drum means as the machine traverses along the working face. The apparatus comprises odometer means 15 for sensing the position of the machine along the working face and for identifying when the leading cutter drum reaches each reference location of a series of spaced reference locations A, B, C, D, E, F, G, H, I . . . extending along the working face and for identifying when the trailing cutter drum reaches each reference location of the series A, B, . . . I . . . The odometer means is adapted to derive first and second signal means indicative of when the leading and trailing drums respectively have reached each desired reference location. The derived signals are transmitted to signal processor means 16 provided on the mining machine. Alternatively, the processor means could be provided remote from the machine.

The mining machine is provided with a mineral thickness sensor 17 arranged to sense the thickness of the residual layer 8 left behind the leading drum 3. The sensor 17 is adapted to derive a signal indicative of the sensed coal thickness, the signal being fed to the processor means 16 which thereby if necessary instructs control means for the aforementioned ram to suitably range the ram associated with the currently leading drum to maintain the thickness of layer 8 within desired preselected limits.

Tilt transducers 18 and 19 are provided to sense the tilt of the mining machine as it traverses along the working face. The transducer 18 senses the tilt of the machine in the direction of machine traverse and the transducer 19 senses the tilt of the machine in a direction transverse to the direction of machine traverse, ie in the direction of working face advance. Both transducers 18 and 19 are arranged to derive signals indicative of the sensed machine tilt, the signals being fed to the processor means 16.

Further transducers 20 and 21 are provided to sense the inclination of the booms 10 and 11, respectively, relatively to the machine body, the transducers feeding signals indicative of the sensed boom inclination to the processor means 16 which thereby is able to compute the current horizons of the cutter drums relatively to the machine body.

A sensor device 100 is provided to sense the roof profile formed on the previous mine roof forming traverse of the machine along the face. The sensor device is arranged to derive a signal indicative of the height of the mine roof formed on the previous traverse and the currently formed roof profile is maintained at or within a preselect distance of the previously formed mine roof.

By monitoring the signal indication of the thickness of the residual layer, the signals indicative of machine tilt, the signals indicative of the boom inclinations and the signal indicative of the position of the previously formed mine roof the processing means is able to compute any mine floor lift affecting the feet 12 and 13 at each of the desired reference locations A, B . . . I . . . along the working face. Also the processor means is able to compute the cutting horizon of the cutter drums at each of the desired reference locations, A, B . . . I . . . along the working face.

Thus in operation as the machine traverses along the face the processor means using the aforementioned indicative signals derived from the various sensors is able to steer the currently leading cutter drum to maintain the thickness of the residual layer 8 within preselected limits and to steer the currently trailing drum to maintain the vertical thickness of the strip of mineral won on each passage of the machine to within preselected limits.

The full line representation in the drawing shows the mining machine 1 with the leading cutter drum 3 at reference location E. Upon reaching this reference location the odometer means 15 derives an indicative signal which is passed to the processor means 16. Simultaneously, the processor means 16 monitors signals from the mineral layer thickness sensor 17 and from the tilt sensors 18 and 19 and from the sensor 20 to determine the cutting horizon of the leading cutter drum. Also the sensor device 100 enables the height of the leading cutter drum on the present cut to be maintained at a preselected height relatively to that on the previous roof forming traverse. All this received information is stored in the processor means 16. The floor lift at the feet 12 is computed and stored in a floor profile array.

The machine continues its traverse along the working face until it reaches the position indicated by the broken line representation in the drawing. Upon reaching this position the trailing cutter drum 5 is at the reference location E and the odometer means 15 derives an indicative signal which is passed to the processor means 16. Simultaneously, the processor means 16 monitors signals from the sensors 18, 19 and 21 to determine the cutting horizon of the trailing cutter drum 5. With the trailing cutter drum at reference location E the trailing feet 13 are at reference location F and the processor means 16 retrieves the floor lift at reference location F from the stored floor profile array. It will be understood that the processor means 16 previously would have monitored the signals derived from the sensors on the machine when the leading cutter drum was at reference location G. From the received information the processor means would have computed the floor lift at F.

With the trailing cutter drum 5 at reference location E the processor means is able to compute the actual cutting horizon of the trailing cutter drum with the desired cutting horizon (corresponding to a desired vertical thickness of the won strip of mineral) and if necessary feeds a steering correction signal to the aforementioned steering ram to suitably adjust the position of the trailing drum within the mineral seam.

As previously explained the above sensing and computing processors are repeated at each of the series of reference locations along a desired length of the longwall mineral working face.

Thus, it will be seen that the present invention provides a reliable and effective method of and apparatus for steering a double ended ranging drum shearer along at least a portion of a longwall face.

Advantageously, the processor means 16 includes override means 30 which limits the maximum extent of any steering correction applied to the cutter drums in order to avoid unacceptably large size and unnegotiable steps being formed in the mine roof or floor.

I claim:

1. A method of steering mineral cutter means provided on a double-ended ranging drum shearer adapted to repeatedly traverse to and fro along a longwall working face, comprising the steps of using a plurality of reference locations spaced at preselected intervals along the longwall working face, sensing the position of the machine along the working face so as to identify when the leading cutter drum reaches a desired reference location and storing that information for later use, sensing the cutting horizon of the leading cutter drum at said desired reference location and storing that information for future use, further sensing the position of the machine along the working face so as to identify when the trailing cutter drum reaches said desired reference location, and steering the trailing cutter drum through use of the previously stored information such that the vertical thickness of the strip of mineral won at said desired reference location tends to be maintained at a preselected value.

2. A method as claimed in claim 1, in which the step of sensing the cutting horizon of the cutter drums comprises sensing the thickness of a residual layer of mineral left behind the leading cutter drum, and sensing the horizon of the cutter drums relatively to the mining machine and sensing the tilt of the mining machine.

3. A method as claimed in claim 2, in which the tilt of the machine both in the direction of machine traverse along the working face and in a direction transverse to the direction of machine traverse.

4. A method as claimed in claim 3, including using odometer means to identify when the cutter drums reach each of the series of reference locations used, the series extending along at least a portion of the working face.

5. Apparatus for steering mineral cutter means provided on a double-ended ranging drum shearer adapted to repeatedly traverse to and fro along a longwall working face, comprising odometer means for sensing the position of the machine along the working face and means for storing that information for future use and for identifying when the leading cutter drum reaches a desired reference location along the working face and for identifying when the trailing cutter drum reaches said desired reference location, sensor means for sensing the cutting reference location and for deriving first and second signal means indicative of the two sensed cutting horizons, respectively, processor means for receiving derived signal means, and for storing at least said first signal means for later use, and steering control means activated by said previously stored information for steering the trailing cutter drum such that the vertical thickness of the strip of mineral won at said desired reference location tends to be maintained at a preselected value.

6. Apparatus as claimed in claim 5, in which the odometer means derives first and second signal means indicative of when the leading and trailing cutter drums reach said desired reference location, respectively, the derived signals being transmitted to the processor means.

7. Apparatus as claimed in claim 6, in which the sensor means comprises first sensor means for sensing the thickness of a residual layer of mineral left behind the leading cutter drum, sensor means for sensing the horizon of the cutter drums relatively to the mining machine and further sensor means for sensing the tilt of the mining machine.

8. Apparatus as claimed in claim 7, in which said further sensors comprise a tilt transducer for sensing the tilt of the mining machine in the direction of machine traverse and a tilt transducer for sensing the tilt of the mining machine in a direction transverse to the direction of machine traverse.

9. Apparatus as claimed in claim 8, in which the odometer means is adapted to identify when the cutter drums reach each of a series of spaced reference locations, the series extending along at least a portion of the longwall working face.

10. Apparatus as claimed in claim 9, in which override means are provided for limiting the maximum extent of any steering correction applied to the cutter drums.

* * * * *